US005639005A

United States Patent [19]

Chouinard

[11] Patent Number: 5,639,005

[45] Date of Patent: Jun. 17, 1997

[54] MODULAR BACKPACK AND UTILITY VEST

[75] Inventor: Yvon Chouinard, Ventura, Calif.

[73] Assignee: Patagonia, Inc., Ventura, Calif.

[21] Appl. No.: 697,030

[22] Filed: Aug. 19, 1996

Related U.S. Application Data

[63] Continuation of Ser. No. 425,977, Apr. 20, 1995, abandoned.

[51] Int. Cl.[6] ..... A45F 3/04

[52] U.S. Cl. ..... 224/580; 224/582

[58] Field of Search ..... 224/151, 153, 224/159–61, 209, 259, 264, 580, 583, 656, 581, 582; 2/94, 102

[56] References Cited

U.S. PATENT DOCUMENTS

| | | | |
|---|---|---|---|
| D. 352,165 | 11/1994 | Covertson | 2/102 X |
| 2,620,479 | 12/1952 | Buck | 2/102 X |
| 2,982,105 | 5/1961 | Akers | 224/656 X |
| 3,357,613 | 12/1967 | Chase | 224/209 X |
| 4,318,502 | 3/1982 | Lowe et al. | 224/153 |
| 4,778,091 | 10/1988 | Barto | 224/159 X |
| 4,793,534 | 12/1988 | Berry | 224/209 |
| 5,014,359 | 5/1991 | Hanson | 2/94 |
| 5,050,998 | 9/1991 | Wachtel | 224/656 X |
| 5,292,044 | 3/1994 | Reimers | 224/264 |

*Primary Examiner*—Renee S. Luebke

*Attorney, Agent, or Firm*—Blakely, Sokoloff, Taylor & Zafman LLP

[57] ABSTRACT

A modular utility vest system is disclosed. A front portion of a utility vest is designed to accommodate the needs of a particular sporting activity. The front portion of the utility vest further includes a pair of buckles at the top of the utility vest near the shoulders of a wearer and a buckle on either side of the vest near the waist of a wearer. A backpack designed for use with the utility vest front portion includes complementary buckles on the tops of the shoulder straps for attaching the top buckles on the utility vest front portion. The backpack further includes complementary buckles on the lower sides of the backpack for attaching the side buckles on the utility vest front portion. If a user wishes to use the utility vest without the backpack, there is a webbing harness that comprises two pieces of webbing sewed in an "X" configuration. The webbing harness is worn on the back of the user and includes two complementary top buckles for attaching to the top buckles on the utility vest front portion. The webbing harness also includes two complementary bottom buckles for attaching to the two side buckles on the utility vest front portion.

15 Claims, 3 Drawing Sheets

MODULAR BACKPACK AND UTILITY VEST

This is a continuation of application Ser. No. 08/425,977, filed Apr. 20, 1995, now abandoned.

FIELD OF THE INVENTION

The present invention is in the field of sporting equipment. Specifically, the present invention discloses a modular backpack and utility vest system wherein a backpack and a utility vest may each be used independently or together as a unit.

BACKGROUND OF THE INVENTION

People who participate in various outdoor sports and activities often wear utility vests for carrying equipment related to their sport. For example, a person who engages in fly-fishing may wear a utility vest that includes a wool patch where fishing hooks may be attached and several pockets for carrying fishing equipment.

At certain times, a person may wish to wear a sport utility vest while also wearing a backpack for carrying additional gear. At other times, the person may wish to wear the utility vest alone. For example, when hiking to a secret fishing site, a person may want to wear a utility vest and a backpack to carry additional equipment. Later, after arriving at the fishing site, the person may wish to take off the backpack and wear the utility vest alone when wading into a river for fly fishing. To provide such flexibility, it would be desirable to have a utility vest that could easily be worn with a backpack or without the backpack.

SUMMARY AND OBJECTS OF THE INVENTION

It is therefore an object of the present invention to provide a modular utility vest system that allows a utility vest to be worn with or without an associated backpack. This and other objectives are achieved by the modular utility vest and backpack of the present invention. A front portion of a utility vest is designed to accommodate the needs of a particular sporting activity. The front portion of the utility vest further includes a pair of buckles at the top of the vest near the shoulders of a wearer and a buckle on either side of the vest near the waist of a wearer. A backpack designed for use with the utility vest front portion includes complementary buckles on the tops of the shoulder straps for coupling to the top buckles on the utility vest front portion. The backpack further includes complementary buckles on the lower sides of the backpack for coupling to the side buckles on the utility vest front portion. If a user wishes to use the utility vest without the backpack, there is a webbing harness that comprises two pieces of webbing sewed in an "X" configuration. The webbing harness is worn on the back of the user and includes two complementary top buckles for coupling to the top buckles on the utility vest front portion. The webbing harness also includes two complementary bottom buckles for coupling to the two side buckles on the utility vest front portion. Thus, the present invention comprises a modular utility vest that may be worn with a complementary backpack or with a simple webbing harness.

Other objects, features and advantages of the present invention will be apparent from the accompanying drawings, and from the detailed description that follows below.

BRIEF DESCRIPTION OF THE DRAWINGS

The objects, features, and advantages of the present invention will be apparent from the following detailed description of the preferred embodiment of the invention with references to the following drawings.

DETAILED DESCRIPTION

A modular backpack and utility vest system is disclosed. In the following description, for purposes of explanation, specific nomenclature is set forth to provide a thorough understanding of the present invention. However, it will be apparent to one skilled in the art that these specific details are not required in order to practice the present invention.

Figure 1:
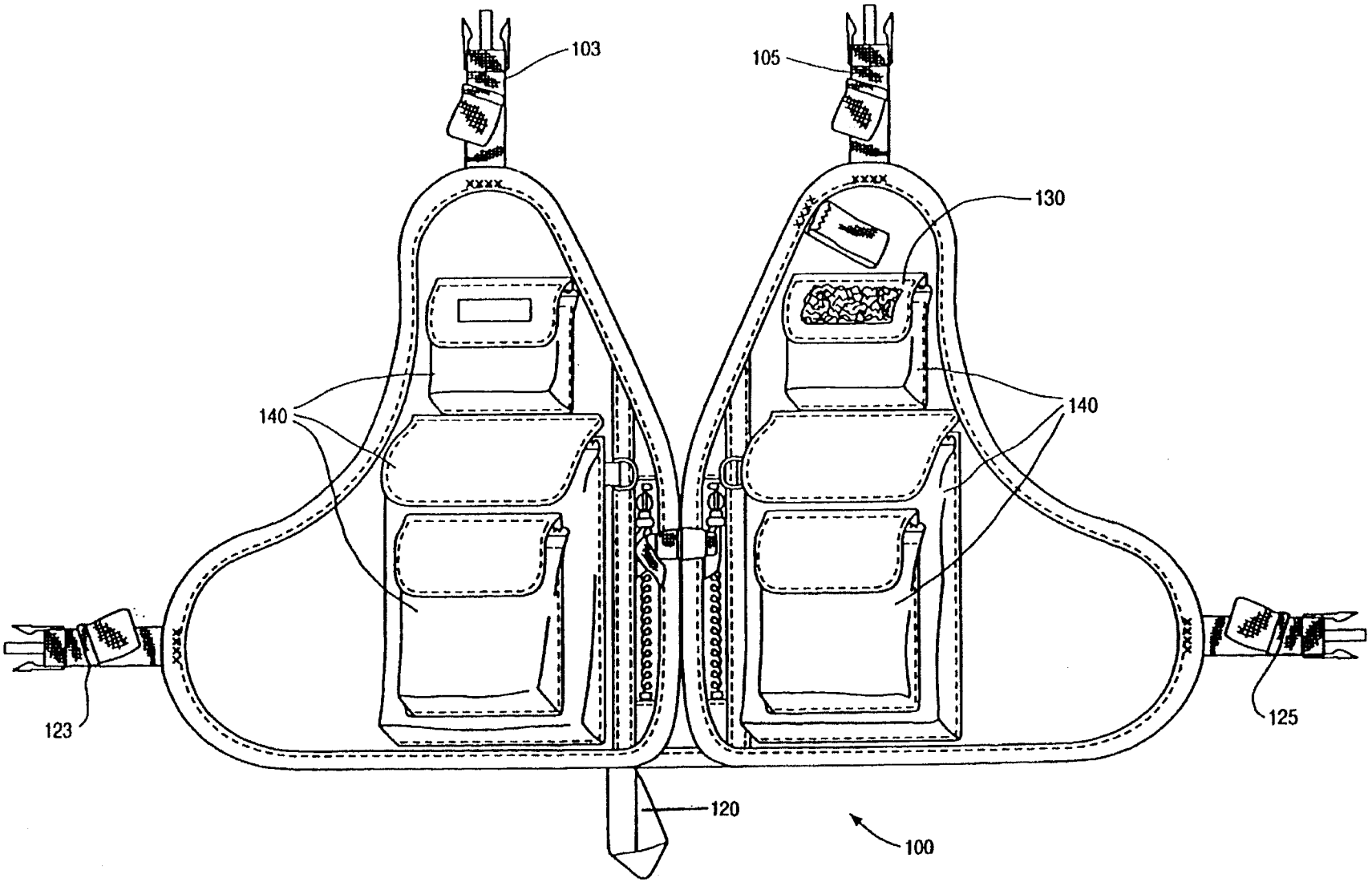
FIG. 1 illustrates a modular utility vest designed for fly fishing.

FIG. 1 illustrates the front portion of a utility vest. The utility vest of FIG. 1 includes several pockets for storing equipment and supplies. The utility vest illustrated in FIG. 1 has been designed specifically for sport fishing. For example, the utility vest of FIG. 1 includes a wool patch 130 where fishing hooks may be attached. The utility vest of FIG. 1 also includes a fabric loop 120 for carrying gear. However, other vests that are designed for other specific activities such as hunting, climbing, and photography can similarly be designed. A utility vest designed for sport hunting might include fabric loops for storing shotgun shells. A utility vest designed for mountain climbing might include gear loops attaching climbing gear such as carabiners, nuts, and Spring Loaded Camming Devices (SCLDs). Finally, a utility vest designed for photography could include pockets and fabric loops for storing film canisters, alternative lenses, and filters.

Only the front portion of a utility vest is illustrated in FIG. 1. The utility vest of FIG. 1 must be attached to some type of harness device worn by a person. The utility vest is connected to a harness device using the top buckles (103 and 105) and the side buckles (123 and 125). Both the top buckles (103 and 105) and the side buckles (123 and 125) have adjustable straps such that the utility vest can accommodate people with different waist sizes and heights.

Figure 2:
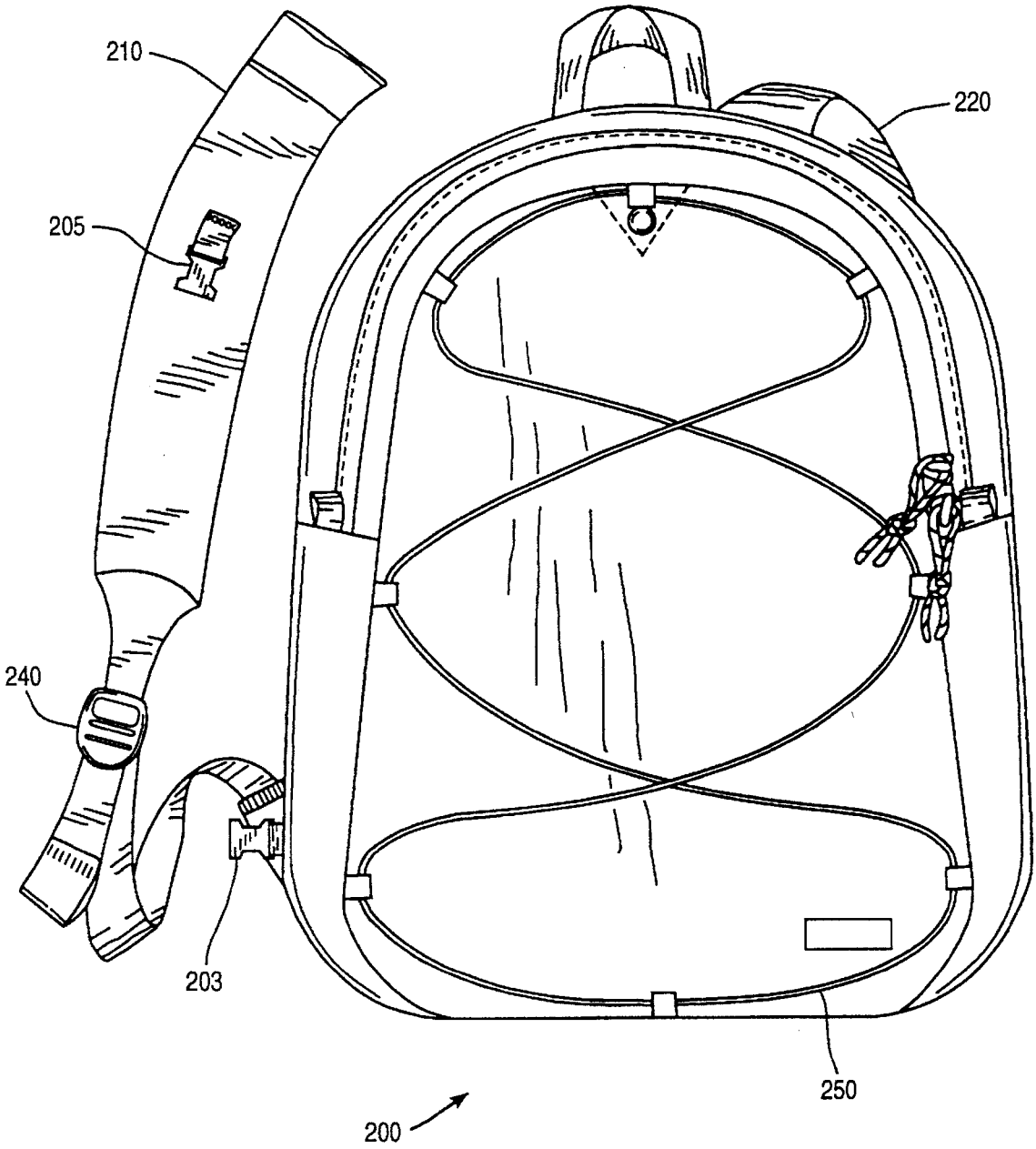
FIG. 2 illustrates a backpack that includes buckles such that the backpack can be used to support the modular utility vest of FIG. 1.

FIG. 2 illustrates a first harness device that may be used to support the front portion of a utility vest illustrated in FIG. 1. The first harness device actually comprises a backpack 200. The backpack 200 includes a cinch string 250 for shrinking the size of the backpack when it is not fully loaded. The cinch string 250 can also be used to carry extra items on the outside of the backpack 200.

The backpack 200 of FIG. 2 has two shoulder straps 210 and 220. (Note that shoulder strap 210 has been detached from the backpack at the top such that it may be illustrated more clearly.) The two shoulder straps 210 and 220 are adjustable since they each have an adjustable buckle (240 for strap 210 and not shown for strap 220) which sets the length of the shoulder strap. Both shoulder straps 210 and 220 also have a buckle (205 for strap 210 and not shown for strap 220) that is complementary to the top buckles on the utility vest of FIG. 1 such that top buckles (103 and 105) of the utility vest front portion 100 can be attached to the shoulder strap buckles. The backpack further includes two side buckles (203 and another side buckle not shown in FIG. 2) that are located near the bottom of the backpack on each side. The two side buckles (203 and the other side buckle not shown in FIG. 2) are complementary buckles such that may connect to the side buckles (123 and 125) of the utility vest front portion 100. Thus, the utility vest front portion 100 can worn by a person who uses the backpack 200.

There are situations when a person may desire to use the utility vest front portion 100 without using the backpack 200. For example, if the utility vest front portion 100 is designed for fly-fishing and the person wishes to flyfish without being encumbered by the bulky backpack 200. For such situations, the webbing harness 300 of FIG. 3 is used of backpack 200.

Figure 3:
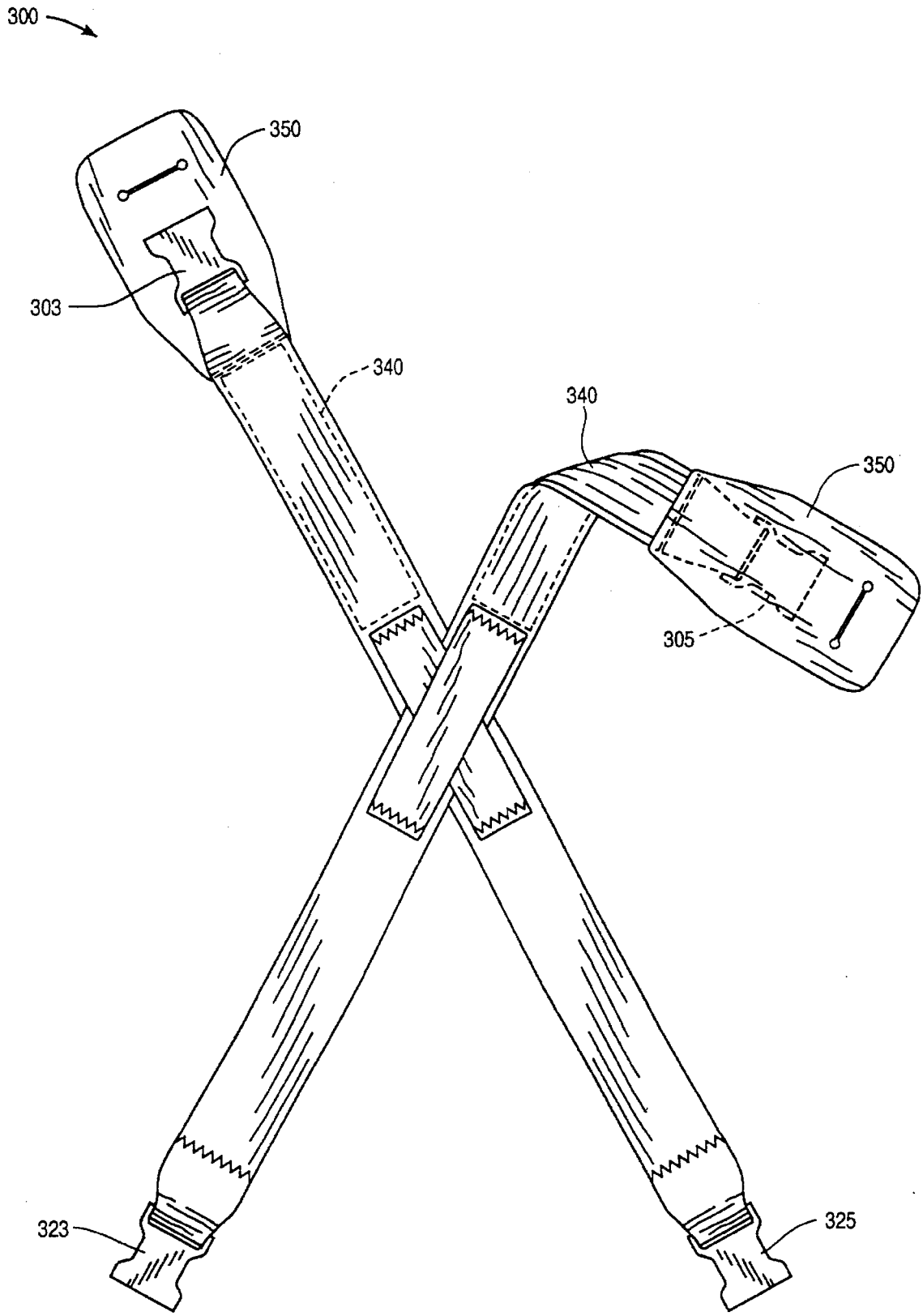
FIG. 3 illustrates a webbing harness that can be used to support the modular utility vest of FIG. 1.

Webbing harness 300 consists of two strips of webbing connected in an "X" configuration as illustrated in FIG. 3. The webbing harness 300 includes two complementary top buckles (303 and 305) at the top of each piece of webbing for coupling to the two top buckles (103 and 105) of the utility vest front portion 100. The two top buckles (103 and 105) are each protected by a neoprene patch 350 that prevents any possible discomfort for the wearer. The webbing harness 300 further includes two complementary bottom buckles (323 and 325) at the bottom of each piece of webbing for attaching the two side buckles (123 and 125) of the utility vest front portion 100. To ensure that the webbing harness 300 holds the utility vest 100 firmly on the wearer, the webbing harness 300 may include a section of material 340 near the shoulder area to provide additional friction. The section of material 340 may comprise TuffGrip™ or another suitable material. Thus, as explained in this specification and illustrated in FIGS. 1, 2, and 3; a modular utility vest has been disclosed.

Although the present invention has been described in terms of specific exemplary embodiments, it will be appreciated that various modifications and alterations might be made by those skilled in the art without departing from the spirit and scope of the invention as set forth in the following claims.

What is claimed is:

1. A modular utility vest and backpack system, said modular utility vest and backpack system comprising:

a front vest portion, said front vest portion comprising
at least one pocket for storing items,
a left shoulder connector coupled to said front vest portion,
a right shoulder connector coupled to said front vest portion,
a left waist connector coupled to said front vest portion,
a right waist connector coupled to said front vest portion;

a backpack, said backpack being an independent unit that can be used by itself, said backpack comprising
a main storage compartment,
a left shoulder strap coupled to said main storage compartment, said left shoulder strap having a left complementary connector for attaching to said left shoulder connector of said front vest portion;
a right shoulder strap coupled to said main storage compartment, said right shoulder strap having a right complementary connector for attaching to said right shoulder connector of said front vest portion,
a left waist complementary connector coupled to said main storage compartment, said left waist complementary connector for attaching to said left waist connector of said front vest portion,
a right waist complementary connector coupled to said main storage compartment, said right waist complementary connector for attaching to said right waist connector of said front vest portion; and a webbing harness; such that said front vest portion can be worn with said backpack and without said webbing harness or said front vest portion can be worn with said webbing harness and without said backpack.

2. The modular utility vest and backpack system as claimed in claim 1 wherein said front vest portion further comprises at least one added feature to accommodate a specific activity.

3. The modular utility vest and backpack system as claimed in claim 2 wherein said added feature comprises a wool patch where at least one fishing hook may be attached.

4. The modular utility vest and backpack system as claimed in claim 2 wherein said added feature comprises a fabric loop for carrying equipment.

5. The modular utility vest and backpack system as claimed in claim 2 wherein said backpack further comprises a cinch string.

6. The modular utility vest and backpack system as claimed in claim 1 wherein said left shoulder connector, said right shoulder connector, said left waist connector, and said right waist connector of said front vest portion all comprise adjustable buckles.

7. The modular utility vest and backpack system as claimed in claim 1 wherein said webbing harness further comprises:

a first piece of webbing, said first piece of webbing including a first complementary top connector attaching to said right shoulder connector and a first complementary bottom connector attaching to said left waist connector; and a second piece of webbing, said second piece of webbing sewed to said first piece of webbing such that said first piece of webbing and said second piece of webbing form an "X" configuration, said second piece of webbing including a second complementary top connector attaching to said left shoulder connector and a second complementary bottom connector attaching to said right waist connector.

8. The modular utility vest and backpack System as claimed in claim 7 wherein said webbing harness further includes a first patch of gripping material on said first piece of webbing near said first complementary top connector and a second patch of gripping material on said second piece of webbing near said second complementary top connector.

9. The modular utility vest and backpack system as claimed in claim 7 wherein said webbing harness further includes a first piece of padding material on said first piece of webbing under said first complementary top connector and a second patch of padding material on said second piece of webbing under said second complementary top connector.

10. A modular utility vest and backpack system, said modular utility vest and backpack system comprising:

a front utility vest portion, said front vest portion comprising
at least one pocket for storing items,
a set of connectors for connecting to a support system;

a backpack, said backpack being an independent unit that can be used by itself, said backpack comprising
a main storage compartment,
a first set of complementary connectors for attaching to said set of connectors on said front vest portion; and a webbing harness, said webbing harness having a second set of
complementary connectors for attaching to said set of connectors on said front vest portion;

such that said front vest portion can be worn with said backpack and without said webbing harness or said front vest portion can be worn with said webbing harness and without said backpack.

11. The modular utility vest and backpack system as claimed in claim 10 wherein said backpack further comprises a cinch string.

12. The modular utility vest and backpack system as claimed in claim 10 wherein said front vest portion further comprises at least one added feature to accommodate a specific activity.

13. The modular utility vest and backpack system as claimed in claim 12 wherein said added feature comprises a wool patch where at least one fishing hook may be attached.

14. The modular utility vest and backpack system as claimed in claim 12 wherein said added feature comprises a fabric loop for carrying equipment.

15. A method a using a modular utility vest and backpack system, said modular utility vest and backpack system comprising a utility vest front portion with a set of connectors, a backpack with a first set of complementary connectors, and a webbing harness with a second set of complementary connectors, said method comprising the steps of:

wearing only said backpack when only said backpack is needed;

wearing said utility vest front portion coupled to said backpack without said webbing harness when both said backpack and utility vest front portion are needed; and wearing said utility vest front portion coupled to said webbing harness without said backpack when only said utility vest front portion is needed.

* * * * *